US011407560B2

(12) United States Patent
Clifford

(10) Patent No.: US 11,407,560 B2
(45) Date of Patent: Aug. 9, 2022

(54) LIQUID CONTAINER HAVING INTEGRATED AUXILIARY FLASK

(71) Applicant: Jeffrey Mason Clifford, Oakland Park, FL (US)

(72) Inventor: Jeffrey Mason Clifford, Oakland Park, FL (US)

( * ) Notice: Subject to any disclaimer, the term of this patent is extended or adjusted under 35 U.S.C. 154(b) by 126 days.

(21) Appl. No.: 16/679,789

(22) Filed: Nov. 11, 2019

(65) Prior Publication Data

US 2020/0189793 A1 Jun. 18, 2020

Related U.S. Application Data

(63) Continuation-in-part of application No. PCT/US2018/027370, filed on Apr. 12, 2018.

(60) Provisional application No. 62/484,808, filed on Apr. 12, 2017.

(51) Int. Cl.
*B65D 21/02* (2006.01)

(52) U.S. Cl.
CPC ..... *B65D 21/0237* (2013.01)

(58) Field of Classification Search
CPC ..... B65D 21/0237; B65D 21/02; B65D 21/0202; B65D 21/0201; B65D 21/0204; B65D 21/0208; B65D 21/0233; B65D 21/0234; B65D 21/023; B65D 21/0228; B65D 21/022; B65D 21/0205; B65D 25/16; B65D 25/18; B65F 1/08; B65F 1/085; F16K 15/147; B05B 11/00446; B05B 11/0097
See application file for complete search history.

(56) References Cited

U.S. PATENT DOCUMENTS 3,903,942 A * 9/1975 Vest ..... B60K 15/04 141/301
4,235,343 A * 11/1980 Thompson ..... B65D 21/0237 215/10
4,473,097 A * 9/1984 Knickerbocker ..... G01F 19/00 141/113
4,524,805 A * 6/1985 Hoffman ..... F16K 15/147 137/846
4,857,062 A * 8/1989 Russell ..... A61M 39/0613 604/256
D307,392 S * 4/1990 Weckman ..... D9/528
(Continued)

FOREIGN PATENT DOCUMENTS

AT 310653 B * 10/1973 ..... B65D 21/0237
CA 2517115 A1 * 2/2007 ..... B65D 47/06
(Continued)

OTHER PUBLICATIONS

Notice of First Office Action, Chinese Patent Office, dated Jan. 6, 2021.

*Primary Examiner* — J. Gregory Pickett
*Assistant Examiner* — Abigail Elizabeth Guidry
(74) *Attorney, Agent, or Firm* — Allen F. Bennett; Bennett Intellectual Property

(57) ABSTRACT

A liquid container having an integrated flask is defined by an outer wall having a recess. A flask is configured to fit within the recess. Tabs for lips extend partially over the recess from the outer wall of the bottle and secure the flask with in the recess by a snap fit. The flask may be removed from the bottle and filled with a lesser amount of liquid and used when traveling.

6 Claims, 5 Drawing Sheets

(56) References Cited

U.S. PATENT DOCUMENTS 4,948,092 A * 8/1990 Kasper ..... F16K 15/147 137/223
5,010,925 A * 4/1991 Atkinson ..... F16K 15/147 137/846
5,050,757 A * 9/1991 Hidding ..... B65D 21/0237 220/23.83
5,062,648 A * 11/1991 Gomringer ..... F16J 15/3204 277/346
5,065,875 A * 11/1991 Balavich ..... B65D 23/12 215/10
D325,340 S * 4/1992 Balavich ..... D9/744
5,301,707 A * 4/1994 Hofsteenge ..... F16K 15/147 137/12
5,316,398 A * 5/1994 Chandaria ..... B65D 21/0237 132/297
5,330,437 A * 7/1994 Durman ..... A61M 39/06 137/846
6,209,757 B1 * 4/2001 Dumont ..... B65D 51/2807 222/145.5
6,415,624 B1 * 7/2002 Connors ..... B65D 21/0237 62/457.3
6,598,757 B2 * 7/2003 Stillinger ..... B65D 5/746 215/387
6,892,899 B2 * 5/2005 Minard ..... A23G 9/08 137/846
6,971,551 B2 * 12/2005 Widgery ..... A47G 19/2266 222/129
7,178,533 B2 * 2/2007 Andrion ..... B65D 23/12 132/308
7,225,937 B2 * 6/2007 Schroeder ..... B65B 61/202 206/497
7,404,497 B2 * 7/2008 Lowance ..... B29C 49/0073 220/23.4
7,748,385 B2 * 7/2010 Lieberman ..... A61M 15/0018 128/207.12
7,837,056 B2 * 11/2010 Stribling ..... A47G 21/185 220/705
8,485,231 B2 * 7/2013 Young ..... A61J 1/1431 141/2
8,777,065 B2 * 7/2014 Knopow ..... B05B 7/2443 222/383.1
9,301,587 B2 * 4/2016 D'Amico ..... B01F 15/0462
9,932,147 B1 * 4/2018 Ahlm ..... B65D 21/0237
10,017,318 B2 * 7/2018 D'Amico ..... A45D 19/00
10,301,054 B2 * 5/2019 Pell ..... A47G 19/2205
10,384,831 B2 * 8/2019 Vlahakis ..... B65D 21/0204
2002/0148247 A1 * 10/2002 Connors ..... F25D 31/007 62/457.3
2003/0111122 A1 * 6/2003 Horton ..... F16K 15/147 137/846
2004/0222229 A1 * 11/2004 Gabbard ..... A47G 19/2272 220/705
2004/0232375 A1 * 11/2004 Steckel ..... F16K 15/147 251/342
2005/0011853 A1 * 1/2005 Brugger ..... B65D 81/3288 215/10
2005/0045630 A1 * 3/2005 Lowance ..... B29C 51/261 220/23.83
2005/0252881 A1 * 11/2005 Zhang ..... B65D 79/005 215/384
2007/0023430 A1 * 2/2007 Seher ..... A61J 1/1406 220/200
2007/0215617 A1 * 9/2007 Lowance ..... B65D 77/0493 220/23.83
2008/0017652 A1 * 1/2008 Roberts ..... B65D 47/06 220/714
2008/0049414 A1 * 2/2008 McKay ..... G01N 21/6447 362/96
2008/0073375 A1 * 3/2008 Nelson ..... B01F 15/0205 222/129
2008/0230508 A1 * 9/2008 Overgaard ..... F25D 31/007 215/386
2008/0264518 A1 * 10/2008 Collins ..... B67D 3/02 141/361
2009/0045192 A1 * 2/2009 Woolf ..... B65D 81/3205 220/23.87
2009/0107859 A1 * 4/2009 Cai ..... B65D 23/12 206/217
2009/0183779 A1 * 7/2009 Minard ..... F16K 15/147 137/14
2009/0272766 A1 * 11/2009 Laible ..... B67D 7/02 222/325
2010/0096313 A1 * 4/2010 Pedersen ..... C02F 1/482 210/222
2010/0314389 A1 * 12/2010 Wojton ..... B65D 21/0204 220/23.4
2011/0079614 A1 * 4/2011 Ganzeboom ..... B23P 6/00 222/181.3
2011/0108139 A1 * 5/2011 Wright ..... F16K 15/147 137/511
2011/0155771 A1 * 6/2011 Brooks ..... F16K 15/147 222/481
2012/0085958 A1 * 4/2012 Yang ..... F16K 15/147 251/336
2014/0263487 A1 * 9/2014 Conwell ..... A45F 3/18 224/148.1
2015/0216723 A1 * 8/2015 Yoshimura ..... B65D 47/2031 604/295
2015/0265079 A1 * 9/2015 Kamping ..... B65D 47/066 220/203.12
2015/0308582 A1 * 10/2015 Basham ..... F16K 24/04 137/388
2016/0198874 A1 * 7/2016 Pisarevsky ..... A61J 7/04 206/217
2020/0038579 A1 * 2/2020 Schultz ..... A61M 3/0233
2020/0398583 A1 * 12/2020 Asawa ..... F04B 53/109
2021/0069391 A1 * 3/2021 Quackenbush ..... A61M 1/064

FOREIGN PATENT DOCUMENTS

CA 3014254 A1 * 2/2019 ..... B65D 21/0237
CN 101253119 A * 8/2008 ..... B67D 7/344
CN 101253119 A 8/2008
EP 0354111 A1 * 2/1990 ..... B65D 21/0237
FR 2821608 A1 * 9/2002 ..... B65D 21/0237
GB 2392898 A * 3/2004 ..... B65D 81/3216
GB 2568959 A * 6/2019 ..... B65D 21/0237
WO WO-9413987 A1 * 6/1994 ..... F16K 15/147

* cited by examiner

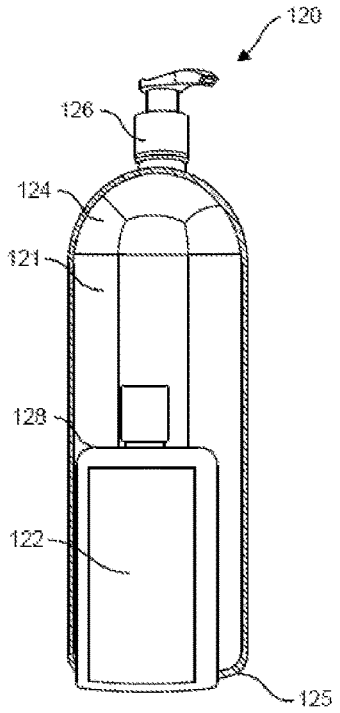
FIG. 8
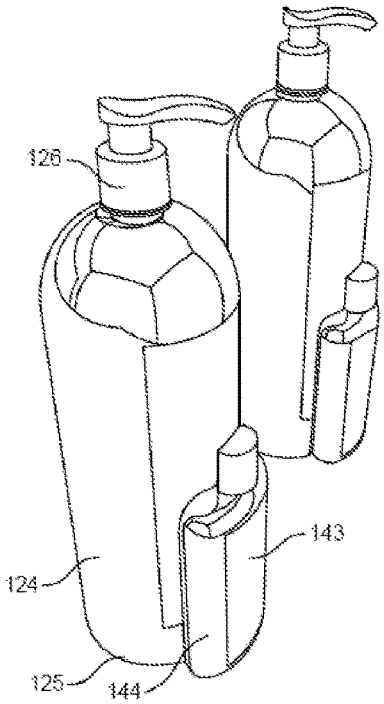
FIG. 9
Fig. 10
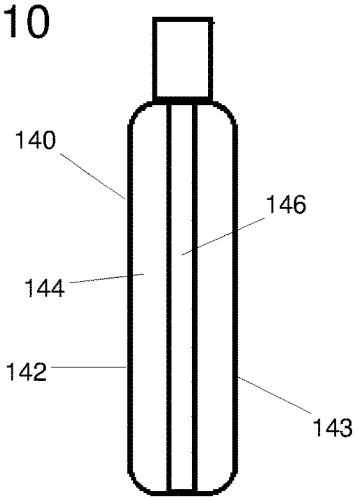
Fig. 11
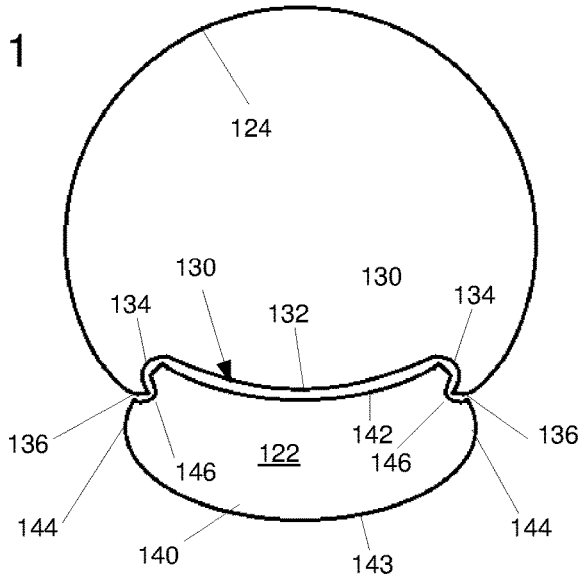

LIQUID CONTAINER HAVING INTEGRATED AUXILIARY FLASK

CROSS-REFERENCE TO RELATED APPLICATIONS

This application claims priority to U.S. Provisional Application Ser. No. 62/484,808 filed on Apr. 12, 2017, and is a continuation-in-part of PCT/US18/027370 filed on Apr. 12, 2018 the contents of which are incorporated.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to a container for liquids having an auxiliary flask. More particularly, the invention relates to a bottle for liquids such as shampoos having a detachable smaller container for containing a smaller portion of the liquid held in the bottle and sized to be convenient for use during short term travel.

Description of the Related Art

When traveling it is often desirable for a person to take his or her preferred type of shampoo. While hosts and hotels typically provide shampoos and conditioners for their guests, people often are very choosy about the type of hair products they use and therefore prefer their own. However, when traveling it is also desirable to carry as little as possible because there is usually limited space for all of a person's possessions within his or her luggage. Typically shampoo bottles are relatively large and contain enough shampoo to last several weeks or months. Thus, traveling with a full-sized shampoo bottle is typically both unnecessary and undesirable.

Many shampoo manufacturers offer shampoo and small travel sized bottles. However these are relatively expensive per unit volume compared to standard shampoo bottles. Purchasing special travel sized bottles also represents an added hassle when preparing for a trip. It is therefore common for a person to utilize a small reusable travel sized bottle. A person can simply fill one of these travel sized bottles with his or her preferred shampoo, conditioner or other liquid. This minimizes the space required within luggage for hair products and avoids the cost and hassle of purchasing smaller sized shampoo bottles.

However, reusable travel sized bottles have their own disadvantages. It is often difficult to pour liquid from a large bottle into a small bottle. Such liquid transfers often create a mess. Furthermore, these travel sized bottles often have leftover shampoo when a trip is concluded. People often forget to pour the leftover shampoo or conditioner back into the original bottle. As a result, the travel sized bottle may contain shampoo, conditioner or other products for the entire time between successive trips, which can be several months or more. By the time the travel sized bottle is reused, the leftover shampoo has often degraded.

Furthermore, the U.S. Transportation Security Administration often limits the size of a liquid bottle that may be brought onto an airplane or other vehicle. If a person wishes to carry conditioner, shampoo or other liquid in a carry-on bag, these rules preclude using a typical shampoo bottle.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a travel sized bottle for liquids that allows simple and efficient transfer to or from a larger bottle intended for at-home use.

BRIEF SUMMARY OF THE INVENTION

Disclosed is a liquid container having an integrated flask comprising a bottle having an outer wall, a lid, a recess in the outer wall. The recess is defined by a back wall, a bottom wall and a top wall. A flask is configured to fit within the recess. The flask has a front wall, a back wall, two sidewalls, a base and a cap. An upper lip extends downward from the top wall of the recess and partially covers the recess. A bottom lip extends upward from the bottom wall of the recess and partially covers the recess.

The top wall of the recess may include a check valve and the cap of the nested bottle includes a nozzle configured to impinge, and thereby open, the check valve of the top wall when the nested bottle is secured within the recess. The first side wall of the recess may include a concave gap.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 8 is a front view of a container having a nested accessory bottle in accordance with the principles of the invention;

FIG. 9 is a perspective view of two containers having a nested accessory bottles in accordance with the principles of the invention;

FIG. 10 is a side view of an accessory bottle in accordance with the principles of the invention;

FIG. 11 is a bottom plan view of an alternative embodiment of a container having a nested accessory bottle in accordance with the principles of the invention;

DETAILED DESCRIPTION

Figure 1:
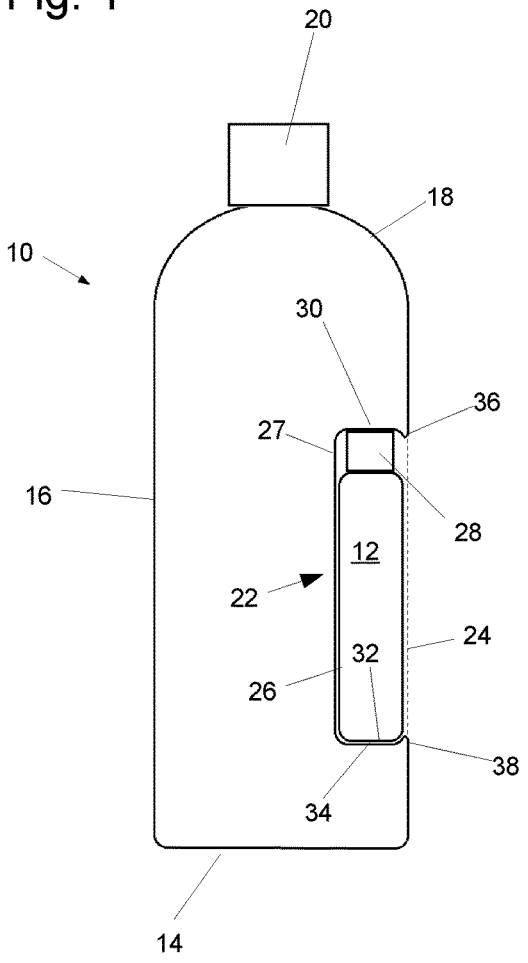
FIG. 1 is a side cross-sectional view of a container having a nested accessory bottle in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. In addition, the term "continuous" generally refers to an object such as a panel or outer wall that has no openings, apertures or holes through it, preventing movement through the object from one side to the other.

Disclosed is a container for liquids having an incorporated smaller, travel sized bottle, or flask, that is removably attached to the outside. The bottles may optionally be configured to provide fluid communication between them when the travel sized bottle is nested in a recess in the larger bottle. For convenience, the liquid containers in this disclosure are often described in terms of shampoo bottles. However, it is to be understood that the liquid containers may also be used for conditioner, other hair products, liquid soap or any other liquid typically stored in a bottle or similar container. This may include particulate matter as well as liquids. Also for convenience, the uses of the bottles are generally described as use during travel. However, such descriptions are exemplary only and the compact flask may be used for other purposes, such as to provide a shampoo or other material for more than one bathroom at a single residence, overnight stays such as slumber parties, or other occasions. In addition, the smaller bottle is generally described as a flask having a flattened configuration. As used herein, the term "flask" is not intended to carry any connotations from the chemical arts or in regard to distilled liquors. The term refers merely to a relatively small bottle that is preferably configured to store easily.

Figure 2:
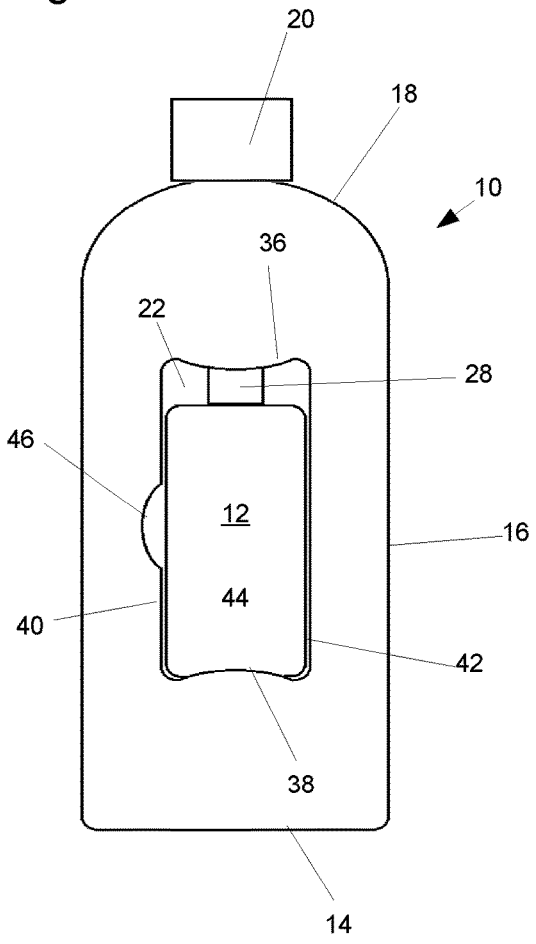
FIG. 2 is a front view of a container having a nested accessory bottle in accordance with the principles of the invention.
Figure 3:
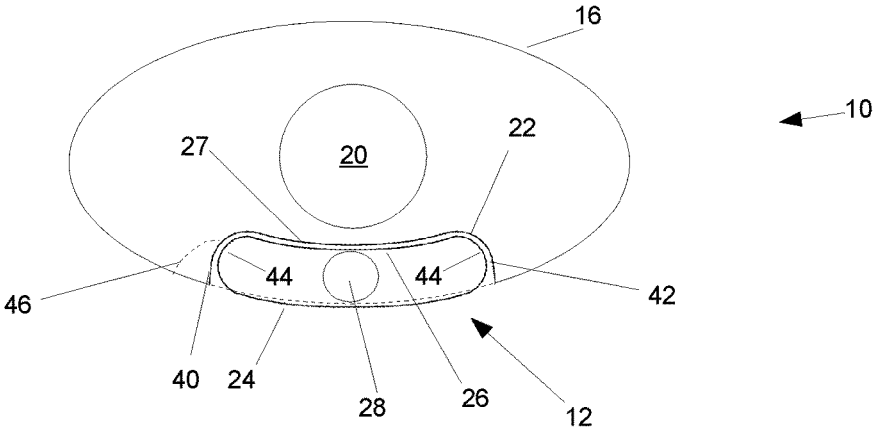
FIG. 3 is a top cross-sectional view of a container having a nested accessory bottle in accordance with the principles of the invention.

FIGS. 1-3 show a liquid container 10 having a nested compact bottle 12 removably attached in accordance with principles of the invention. In this embodiment, the liquid container 10 is a typical 16 ounce shampoo bottle. Those skilled in the art will appreciate that the liquid container 10 may optionally be larger or smaller than 16 ounces. Similarly, the nested compact bottle 12 of this embodiment is 3 ounces and sized to allow a person to include the nested bottle 12 in a carry-on bag through airport security.

The liquid container 10 is defined by a flat base 14, a sidewall 16, a curved top 18 and a screw on lid 20. In this embodiment, the liquid container 10 has an oval cross-section. The nested bottle 12 is removably retained within a recess 22 located on the sidewall 16 of the liquid container 10. The recess 22 is configured to be complementary to the nested compact bottle 12. The exterior wall 24 of the nested bottle 12 lies substantially flush with the sidewall 16. The interior wall 26 lies flush with the back wall 27 of the recess 22. This configuration provides maximized efficiency of space. The compact bottle's cap 28 abuts the top wall 30 of the recess 22, and the bottle's base 32 abuts the bottom wall 34 of the recess 22. In this embodiment, the nested compact bottle 12 has a curved shape. Optionally, other shapes are also suitable.

An upper lip 36 and a lower lip 38 extend partially over the recess 22, thereby providing secure retention of the nested compact bottle 12 within the recess 22. In this embodiment, the upper lip 36 and lower lip 38 are both convex. However, other geometries are also suitable. A first recess sidewall 40 and a second recess sidewall 42 are configured to lie substantially flush with the sides 44 of the nested bottle 12. In this embodiment, the first recessed sidewall 40 has a concave gap 46 that allows an operator to use his or her finger or thumb to assist in dislodging the nested bottle 12 from the recess 22. An additional concave gap 46 may be positioned on the opposite side of the recess 22. In this embodiment, the lips 36 and 38 extend from the top wall 30 and bottom wall 34, respectively. Optionally, lips may extend from the first recessed sidewall 40 and second recess sidewall 42 and the gap 46 may be positioned on the top wall 30 and/or bottom wall 34.

Figure 4:
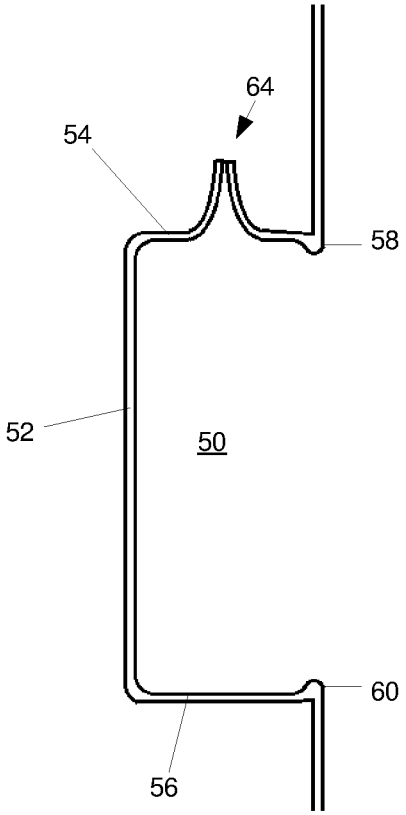
FIG. 4 is a side cross-sectional view of an alternative embodiment of a recess in a container in accordance with the principles of the invention.

FIG. 4 shows an alternative embodiment of a recess 50 in accordance with principles of the invention. Recess 50 is defined by a back wall 52, a top wall 54 and a bottom wall 56. An upper lip 58 extends partially over the recess 50 from the top wall 54 and a lower lip 60 extends partially over the recess 50 from the bottom wall 56. The top wall 54 includes a check valve 64. In this embodiment, the check valve 64 is a duckbill valve.

Figure 5:
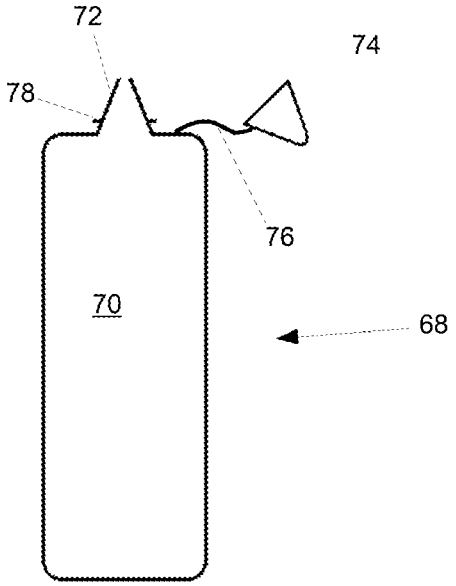
FIG. 5 is a side cross-sectional view of an alternative embodiment of a nested compact bottle in accordance with the principles of the invention.

FIG. 5 shows an alternative embodiment of a nested bottle 68 in accordance with the principles of the invention. The nested bottle 68 has a body 70 configured to be complementary to the recess 50 shown in FIG. 4. The compact bottle 68 includes a nozzle 72 configured to engage and open the duckbill check valve 64 of the recess 50 shown in FIG. 4. The nested bottle 68 also includes a cap 74 affixed to the compact nested bottle by a tether 76. The cap 74 may be used to cover the nozzle 72 when the nested bottle 68 is not secured in the recess 50. The cap 74 may be secured over the nozzle 72 by engaging an annular rib 78.

Figure 6:
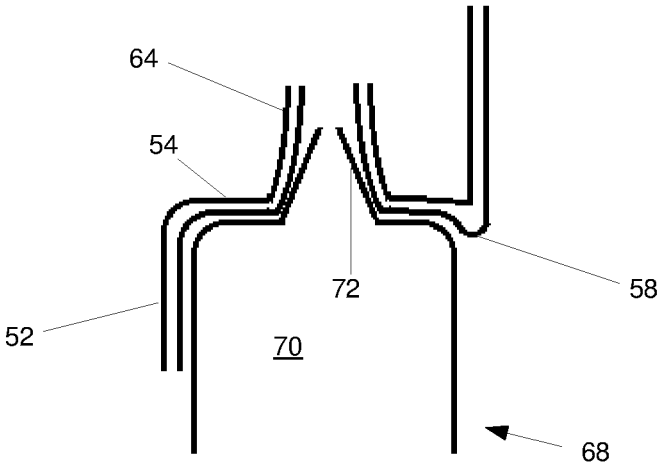
FIG. 6 is a side cross-sectional view of the recess of FIG. 4 engaged with the nested bottle of FIG. 5 and accordance with the principles of the invention.

FIG. 6 shows the compact bottle 68 nested within the recess 50. When the nozzle 72 impinges upon the check valve 64, the check valve 64 is held open. This allows liquid to flow between the nested bottle 68 and the container to which it is affixed.

In use, the compact bottle 68 is placed within the cavity 50 and the nozzle 72 holds the check valve 64 in the open position. To fill the compact bottle 68, an operator need only ensure that the check valve 64 is at least partially submerged within the fluid in the bottle. Once the compact bottle 68 is filled with liquid, it may be removed and used as a travel sized bottle. When the compact bottle 68 is reinserted into the recess 50, the open check valve 64 allows remaining fluid within the compact bottle to be returned to the container from which it came. In this embodiment, it is often preferable to have means of very firmly and securely affixing the compact bottle 68 within the cavity 50.

Figure 7:
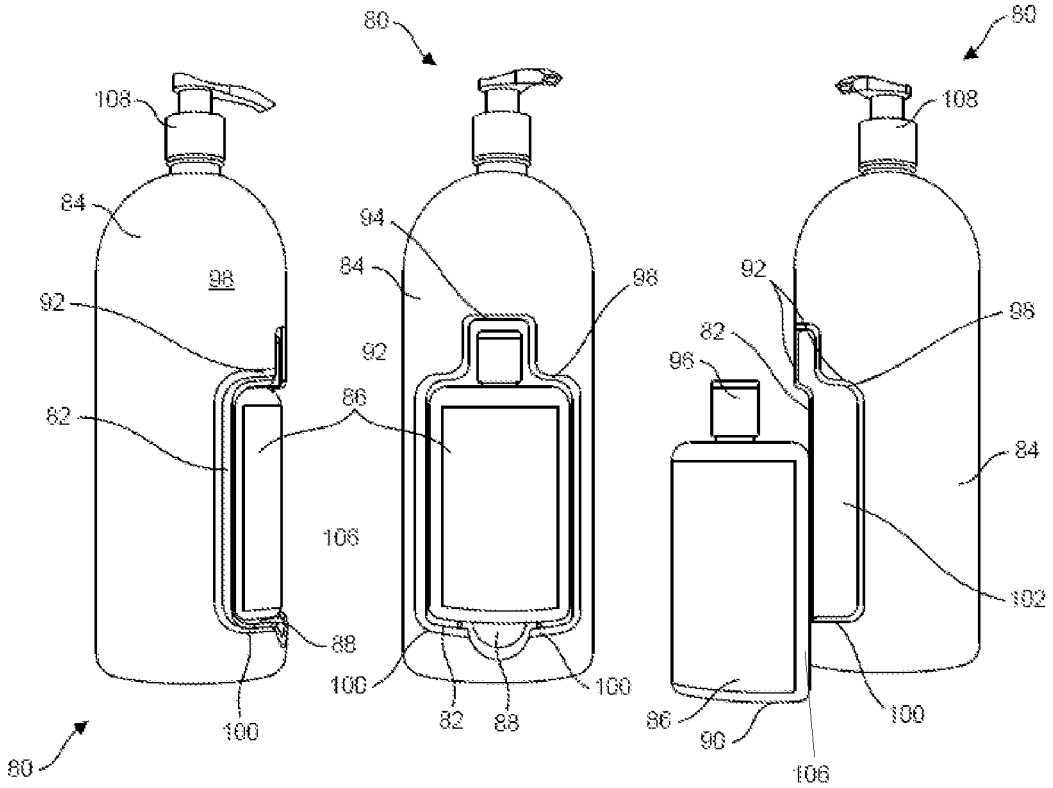
FIG. 7 is a perspective view of three containers having nested accessory bottles in accordance with the principles of the invention.

FIG. 7 shows three identical bottles 80 having recess 82 in their outer walls 84 for storing a flask 86. The recess 82 and the flask 86 are complementary; that is, the flask 86 is configured to fit snugly within the recess 82. This maximizes efficient use of space and includes the ease with which the flask 86 may be snapped into place within the recess 82. At the bottom of each recess 82 is finger gap 88 which allows an operator to use his or her finger to impinge on the base 90 of the flask 86 and pop it out of the recess 82. At the top of the recess 82 are two shoulders 92 that defined a head region 94 in the recess configured to be complementary to the cap 96 of the flask 86. Each of the shoulders 92 have a shoulder lip 98 that extends partially downward over the recess 82. Two lower lips 100 extend upward over the recess 82 from either side of the access recess 88. The shoulder lips 98 and the lower lips 100 together hold the flask 86 securely within the recess 82. In this embodiment, both the bottle 80 in the flask 86 are self-contained. The wall 102 of the recess 82 is continuous with the outer wall of the bottle 80. The bottle 80 has only a single opening located underneath its cap 108. Similarly, the flask 86 is defined by a wall 106 that is continuous such that the flask 86 has only one opening directly underneath its cap 96. In use, an operator may fill the flask 86 with liquid from the bottle 80 in order to use the flask 86 to transport a smaller portion of the liquid. For example, an operator may have a relatively large bottle of shampoo. When the operator goes on a vacation, it is undesirable to use precious storage space within his or her luggage to carry far more shampoo than will be required on the trip. Thus, the operator may fill the flask 86 with shampoo and take only the flask 86 on a trip inside of the entire bottle 80.

FIGS. 8-11 show another alternative embodiment of a liquid container 120 having an integrated flask in accordance with the principles of the invention. In this embodiment, the liquid container, or bottle, 121 has a substantially cylindrical body and domed top defined by an outer wall 124 and a base 125. The outer wall 124 is continuous and the only opening is underneath the cap 126. As with other embodiments, the outer wall 124 of the liquid container 120 includes a recess 128 complementary to an integrated flask 122. The recess 128 has a back wall 132, two concave side walls 134 and two lateral lips 136 extending partially over the recess 130. In this embodiment, the recess 128 is accessible both from the side and from the base 125.

The flask 122 has a curved body defined by outer wall 140. The flask 122 has a back wall 142 that lies flush against the back wall 132 of the recess 130 when the flask 122 is retained within the recess 128. The front wall 143 of the flask 122 faces outward and is visible when the flask 122 is attached to the liquid container 120. Both sides 144 of the flask 122 have a vertical groove 146 complementary to the lateral lips 136. The back wall 142, the sides 144 and the grooves 146 form a friction fit with the back wall 132, the sidewalls 134 and the lateral lips 136 of the recess 128 to secure the flask 122 in place. To remove the flask 122, an operator slides the flask 122 downward relative to the bottle 121. Conversely, to affix the flask 122, an operator aligns the grooves 146 with the lips 136 and slides the flask 122 upward relative to the bottle 121.

Figure 12:
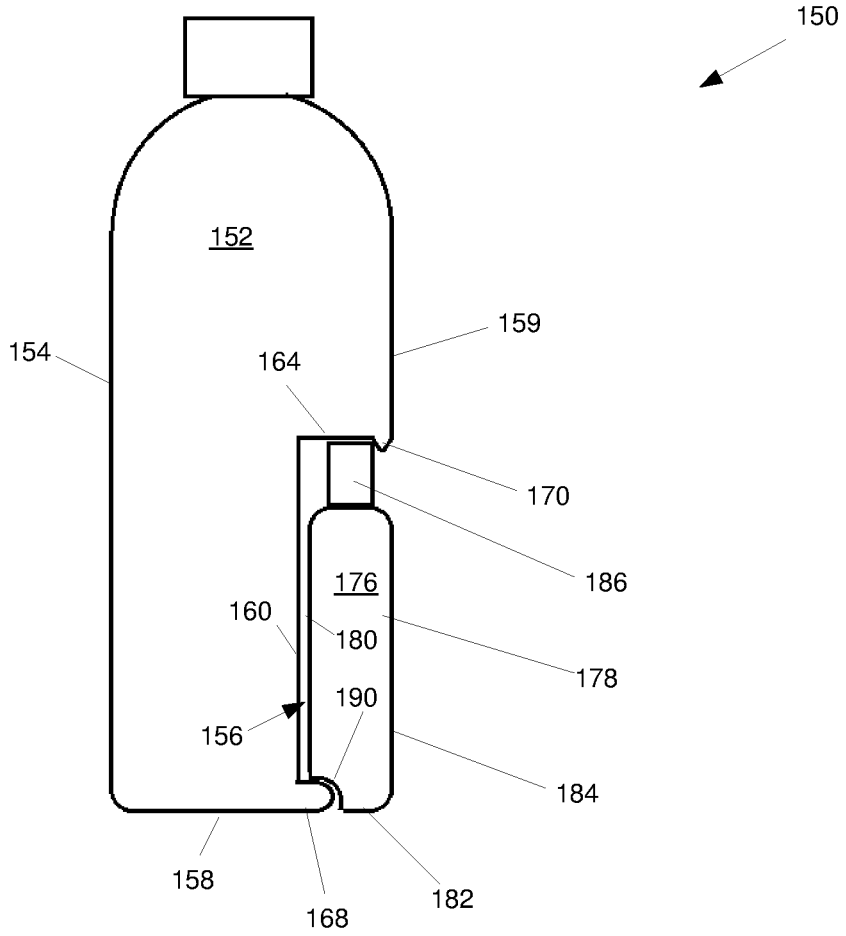
FIG. 12 is a side view of an alternative embodiment of a container having a nested accessory bottle in accordance with the principles of the invention.
Figure 13:
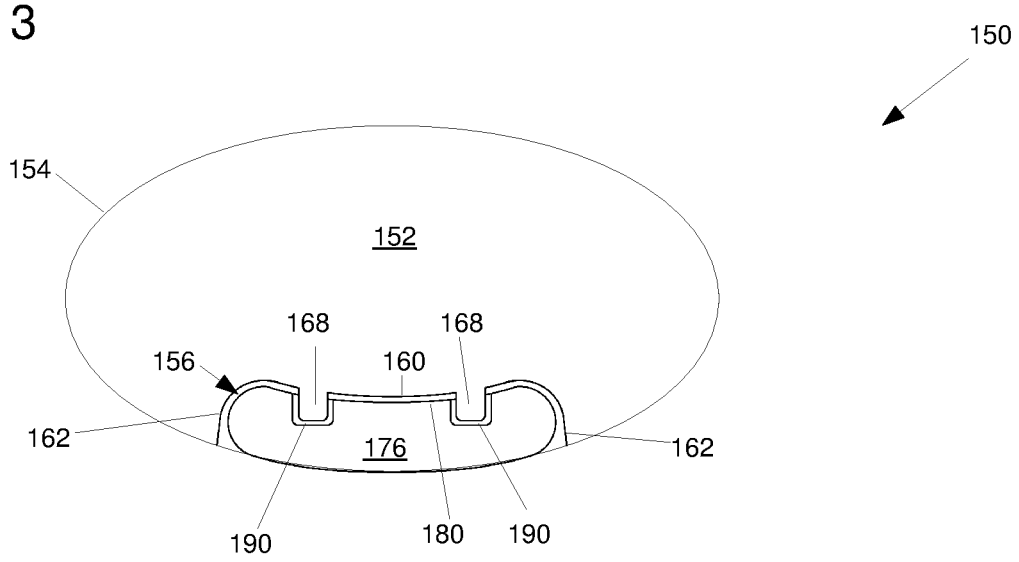
FIG. 13 is a cross-sectional view of an alternative embodiment of a container having a nested accessory bottle in accordance with the principles of the invention.

FIGS. 12 and 13 show another alternative embodiment of a liquid container having an integrated flask 150 in accordance with the principles of the invention. A bottle 152 of this embodiment has an elliptical cross-section defined by a continuous outer wall 154. A recess 156 extends from the base 158 of the bottle 152 partially up a first side 159 of the outer wall 154, and is defined by a back wall 160, two sidewalls 162 and a top wall 164. Two tabs 168 extend partially over the recess from the base 158 of the bottle 152. In this embodiment, the tabs 168 are coplanar with the base 158. Optionally, the tabs 168 may be positioned at a different location within the recess 156. An upper lip 170 extends from the outer wall 154 downward from the top wall 164 and partially over the recess 156.

A flask 176 is configured to be complementary to and fit snugly within recess 156. The flask 176 has a continuous outer wall 178 defined by a back wall 180, a base 182, and a front wall 184. A cap 186 on the top of the flask 176 covers the only opening into the flask. Two pockets 190 are located where the back wall 180 meets the base 182. The pockets 190 are configured to be complementary to the tabs 168 of the bottle 152. When the flask 176 is located within the recess 156, the tabs 168 extend into the pockets 190 and together with the upper lip 170 retain the flask 176 within the cavity 156. In this embodiment, the bottle 152 has two tabs 168 that are complementary to the two pockets 190. Optionally, only one tab could be used. Similarly, additional tabs may also be used to secure the flask 176 within the cavity 156.

Whereas, the present invention has been described in relation to the drawings attached hereto, other and further modifications, apart from those shown or suggested herein, may be made within the spirit and scope of this invention. Those skilled in the art will appreciate that the conception, upon which this disclosure is based, may readily be utilized as a basis for the designing of other structures, methods and systems for carrying out the several purposes of the present invention. Descriptions of the embodiments shown in the drawings should not be construed as limiting or defining the ordinary and plain meanings of the terms of the claims unless such is explicitly indicated. The claims should be regarded as including such equivalent constructions insofar as they do not depart from the spirit and scope of the present invention.

The invention claimed is:

1. A liquid container having a nested compact bottle comprising:

the liquid container having an oval cross section and defined by a flat base, a sidewall, a curved top and a lid;

a recess located on the sidewall of the liquid container and defined by a convex back wall, a top wall, a bottom wall, and two sidewalls;

the nested compact bottle complementary to the recess in the liquid container, and having a curved shape defined by a convex exterior wall, an interior concave wall, two curved side walls, and a cap;

an upper lip extending over the recess from the top wall; and a lower lip extending over the recess from the bottom wall;

wherein, when the nested compact bottle is removably inserted into the recess, its interior wall lies flush against the back wall of the recess and the exterior wall of the nested compact bottle is flush with the sidewall of the liquid container;

a check valve in the top wall of the recess; and wherein the nested compact bottle includes a nozzle configured to engage and hold open the check valve in the top wall of the recess when the cap is removed from the nested compact bottle and the nested compact bottle is secured within the recess, thereby providing fluid communication between the liquid container and the nested compact bottle.

2. The liquid container having a nested compact bottle of claim 1 further comprising a concave gap in one of the sidewalls of the recess.

3. The liquid container having a nested compact bottle of claim 1 wherein the check valve is a duckbill valve.

4. The liquid container having a nested compact bottle of claim 3 further comprising a concave gap in one of the sidewalls of the recess.

5. A liquid container having a nested compact bottle comprising:

the liquid container having an oval cross section, a flat base and an outer wall;

a recess extending from the flat base partially up a first side of the outer wall of the liquid container, wherein the recess is defined by a curved back wall, two curved sidewalls and a top wall;

a check valve in the top wall of the recess;

an upper lip extending over the recess from the top wall;

one or more tabs extending partially over the recess from the flat base of the liquid container; and, the nested compact bottle complementary to the recess in the liquid container, and defined by an exterior wall, an interior wall, two curved side walls, and a cap, wherein the nested compact bottle has one or more pockets complementary to the one or more tabs;

wherein, when the nested compact bottle is removably inserted into the recess, its interior wall lies flush against the back wall of the recess, the exterior wall of the nested compact bottle is flush with the outer wall of the liquid container, and the one or more tabs extend into the one or more complementary pockets of the nested compact bottle;

wherein the nested compact bottle includes a nozzle configured to engage and hold open the check valve in the top wall of the recess when the cap is removed from the nested compact bottle and the nested compact bottle is secured within the recess, thereby providing fluid communication between the liquid container and the nested compact bottle.

6. The liquid container having a nested compact bottle of claim 5 wherein the check valve is a duckbill valve.

* * * * *